US007514989B1

(12) United States Patent
Somerville et al.

(10) Patent No.: US 7,514,989 B1
(45) Date of Patent: Apr. 7, 2009

(54) DYNAMIC MATCHING OF CURRENT SOURCES

(75) Inventors: Alan Murray Somerville, Tokyo (JP); Shiho Hiroshima, Tokyo (JP); Chris Foran, Old Windsor (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 0 days.

(21) Appl. No.: 11/998,100

(22) Filed: Nov. 28, 2007

(51) Int. Cl.
*G05F 1/10* (2006.01)

(52) U.S. Cl. ..... 327/543; 327/538

(58) Field of Classification Search ..... 327/538, 327/540, 541, 543
See application file for complete search history.

(56) References Cited

U.S. PATENT DOCUMENTS 4,608,530 A * 8/1986 Bacrania ..... 323/315
4,766,366 A 8/1988 Davis
4,967,140 A 10/1990 Groeneveld et al.
5,581,209 A 12/1996 McClure
5,793,247 A * 8/1998 McClure ..... 327/538
6,417,723 B1 * 7/2002 Srodzinski ..... 327/538
6,462,527 B1 * 10/2002 Maneatis ..... 323/315
6,999,048 B2 2/2006 Sun et al.
7,042,374 B1 * 5/2006 Manganaro ..... 341/120
7,071,904 B2 * 7/2006 DeCaro et al. ..... 345/76
7,076,384 B1 * 7/2006 Radulov et al. ..... 702/85
7,161,412 B1 * 1/2007 Manganaro ..... 327/543

* cited by examiner

*Primary Examiner*—Lincoln Donovan
*Assistant Examiner*—Hai L. Nguyen
(74) *Attorney, Agent, or Firm*—Saile Ackerman LLC; Stephen B. Ackerman

(57) ABSTRACT

A new system including circuit and methods are given to realize a dynamic matching of current sources, which are arranged as arrays of sets of current sources with added piece-wise switchable trim bit transistors. The matching is achieved during an programmed calibration and trimming step by switching ON/OFF certain trim bit transistors until a required accuracy compared to a master reference is reached. The accuracy of the current source trimming is purely a function of the LSB size, and the trim range a function of the number of trim bits. Applying these new principles the drawbacks with regard to chip space and cost of prior art solutions can be overcome. Making use of modern chip manufacturing technologies allows for a very flexible and adaptive production of large arrays of current sources, as e.g. used in driver ICs for OLED displays.

30 Claims, 6 Drawing Sheets

DYNAMIC MATCHING OF CURRENT SOURCES

BACKGROUND OF THE INVENTION (1) Field of the Invention

The present invention relates in general to current source circuits, and particularly to a set of current source circuits exhibiting adapting or trimming capabilities; even more particularly to sets of multiple matched current source circuits used in LED drivers manufactured as semiconductor integrated circuits.

(2) Description of the Prior Art

Recent development trends in electronic devices for modern flexible and versatile telecommunications and data processing equipment combine various all-purpose applications into one single device often additionally featuring image displaying capabilities thus fostering an increased application of high quality displays. These displays are also enhancing usability by offering easy to use man-machine interfaces, thus playing an important role in customers' acceptance of the equipment. Such displays are nowadays mostly from the LCD (Liquid Crystal Display) type fabricated in STN (Standard Twisted Nematic) or TFT (Thin Film Transistor) technology needing additional back-lighting but of late often also made as LED (Light Emitting Diode) displays in form of self-luminescent OLED (Organic LED) and PLED (Polymer LED) devices. Ever more displays, being capable to exhibit their own luminosity without extra light sources are preferred. Worth being mentioned in this context are also so-called Surface conduction Electron Emitter Displays (SEDs), High Dynamic Range (HDR) displays, Field Emission Displays (FED) and most recently presented, QDLED-Displays making use of Quantum Dot crystals. Currently in common use are OLED and PLED displays however, in PMOLED (Passive Matrix Organic) LED and AMOLED Active Matrix Organic) LED structure forms. As is well know for such displays, optimum performance especially with highbrightness LEDs is achieved only when the LEDs are driven by current sources rather than by voltage sources. Most modern integrated LED driver circuits are therefore utilizing multiple sets or arrays of almost identical current sources. Due to manufacturing variations during the semiconductor production process a strict conformity to the design values is never reached and in order to keep the errors small an often practiced method is to make the relevant transistor structure dimensions much larger than technological design rules would require, thus matching the resulting current sources better to each other and/or to other external actualities by minimizing the relative errors, although wasting lots of chip area which is therefore a rather costly method. Another viable way to reduce manufacturing errors is to trim during a subsequently added separate production step crucial transistor dimensions of the current sources e.g. by laser trimming, in order to guarantee a prescribed uniformity within one set and also allowing respectively first making possible the principal tracking of pixel specifications from the adjoint LED display e.g. for color hue, brightness, saturation values and the like. These quasi-static matching of the corrected current sources is then dynamically superimposed by individually controlled appropriate display driver signals enabling the current sources actual main task of driving the LED pixels for showing the real information.

As can already be seen from the above both methods to achieve a better matching of the current sources are really expensive, either because of the surplus chip area consumed and/or because of the excessively time consuming trimming and the costly laser and measurement equipment necessitated by that extra production step.

Circuits for current sources exist as prior art in numerous variants, they are also utilized in form of current mirrors: the most suitable and well known basic forms in the art are designated as Widlar and Wilson current sources, whereby said basic Widlar current source made up of two transistors shall be used in case of our preferred embodiment of the invention taken here as showcase and described later on in greater detail. More advanced circuits are realized as Cascode current sources or Temperature-Stabilized current sources directly derived from these basic forms; as more advanced current mirrors may be mentioned Cascode current mirrors and Buffered current mirrors, also High Swing, Stacked, Beta Helper added and Super Wilson subtypes, all these exhibiting much more complex structures, but also always showing the same underlying circuit basics so that the principles of the invention as explained later on can easily be applied to all these circuits. These same or slightly modified circuits are also used for current Sink purposes or for current source as Load applications, especially in form of Complementary current source Loads; even more advanced as current source or current sink Load Inverters, which are often used in memory driver circuits, especially for modern nonvolatile memory technologies such as Magnetoresitive (MRAM) and Ferroelectric (FRAM) Random Access Memory (RAM) technologies. Important also to bear in mind: all these current source, sink or load circuits mentioned above can be implemented either as Bipolar Junction Transistor (BJT) or as Metal-Oxide Semiconductor Transistor (MOST) devices. In both technologies the discrete parameters of the current sources are defined by the structural dimensions of the transistors involved, mainly the dimensions of the emitter or gate areas, which are thus crucial for the dimensioning of the circuits.

Modern industrial applications making use of such types of Current Source/Mirror/Sink/Load circuits can be found in many fields; one important example is e.g. within an electrical tomography system, whereby accuracy and stability of these circuits as crucial components in these systems are playing an important role because of its direct influence on the exactitude of the results for medical diagnostics.

A variety of solutions is found in the prior art for controlling structural device features in an attempt to simultaneously reach the two competing goals namely manufacturing accuracy for matching multiple devices and cost effectiveness in production. Nevertheless, additional improvements in both fields are desired and continued improvements in these areas are needed. It is therefore a challenge for the designer of such circuits to achieve an even more flexible solution which is also furnishing a higher accuracy. There are various patents referring to such solutions.

U.S. Pat. No. 4,766,366 to Davis presents a trimmable current source for use with low voltage circuitry which includes a plurality of trimming networks. A voltage-divider circuit is connected to the trimming networks. Each of the trimming networks includes a resistor in an isolated epitaxial region series connected to a zener diode. A programming signal, having a voltage level which would normally damage the low voltage circuitry can be applied to the junction of the resistor and zener diode, and to the isolated epitaxial region containing the resistor of the trimming network to be programmed without damage to the low voltage circuitry.

U.S. Pat. No. 4,967,140 to Groeneveld et al. discloses a current source arrangement in which N configurations of N+1 transistor configurations (TC_1 to TC_N+1) comprising control transistors (T_1 to T_N+1) and control inputs (CI_1 to CI_N+1) are connected to N outputs (1, 2, . . . N) by means of a switching network in accordance with a cyclic pattern N. The remaining configuration is connected to a correction circuit which includes a reference-current-source for adjusting the control voltage of the control transistor via the control input of the relevant transistor configuration, in such a way that the output current of the relevant configuration becomes equal to that of the reference-current-source.

U.S. Pat. No. 5,581,209 to McClure teaches an adjustable current source wherein an output driver circuit for an integrated circuit is disclosed, where the output driver drives an output terminal with a high logic level having a voltage limited from the power supply voltage of the integrated circuit. The limited voltage is provided by applying a limited output high voltage to an output buffer, such that the drive signal applied to the gate of the pull-up transistor in the output driver is limited by the limited output high voltage applied to the output buffer. A voltage reference and regulator circuit for generating the limited output high voltage is also disclosed, and is based on a current mirror. The sum of the current in the current mirror is controlled by a bias current source, which may be dynamically controlled within the operating cycle or programmed by way of fuses. An offset compensating current source adds current into the reference leg of the current mirror to eliminate the development of an offset voltage in the current mirror, and the limited output high voltage is shifted by the threshold voltage of the pull-up drive transistor by way of a threshold shift circuit.

U.S. Pat. No. 6,999,048 to Sun et al. describes an integrated data driver used in a current-driving display device which includes a digital-to-analog current converter for transforming a digital signal into an analog current signal, and a plurality of sets of data driving circuits for driving a plurality of corresponding data lines, whereby each set of data driving circuits includes a current-copying/reproducing module and a control circuit. The current-copying/reproducing module is used to store a predetermined voltage for conducting the analog current signal in a transforming/storing status and to conduct a reproducing current signal, which is generated by the predetermined voltage, to the corresponding data line in a reproducing/sustaining status. The control circuit is electrically connected between the digital-to-analog current converter and the current-copying/reproducing module for providing a switch between the transforming/storing status and the reproducing/sustaining status.

In the prior art, there are different technical approaches to achieve the goal of a higher accuracy production and/or for easier trimming methods of the integrated current source circuits. However these approaches use often solutions, which are somewhat technically complex and therefore also expensive in production. It would therefore be advantageous to reduce the expenses in both areas.

SUMMARY OF THE INVENTION

A principal object of the present invention is to realize a system for a dynamically matching current source circuits array exhibiting a low chip area consumption and at the same time high accuracy and flexibility.

Another principal object of the present invention is to provide an effective and very manufacturable method for implementing a circuit for a dynamically matching current source array as an integrated circuit (IC) for MOSFET technology.

A further principal object of the present invention is to allow an automatic calibrating and trimming operation using controlled switches, a current comparator and a trim control logic block for controlling and selecting operations.

Further another object of the present invention is to give a method for adjusting current sources by selectively switching in and out auxiliary current adding transistors, so-called trim bit transistors with their related bit selector switches.

Still another object of the present invention is to give a method whereby each current source is switched to a current comparator in turn, and where the trim control logic then selects the position of the trim bit selector switches (X . . . 0) depending on the output of the comparator, such that the current source is within one LSB of a master reference (for example within 1%).

Another still further object of the present invention is to use an automatic piecewise trimming algorithm for each current source to match a master reference, such that each current source consisting of multiple elements, can be tailored according to the current comparator output.

Still another object of the present invention is to simplify the design of high accuracy current source arrays by an easy adaptability to specification demands, being that a precise matching to a master reference or to different other specification values.

Also still another object of the present invention is to simplify the production of current source array circuits by simple and quite regular layouts, as made possible by using a multitude of identical circuit structures.

Further a still other object of the present invention is to make better use of such automatic calibrating cycles e.g. during power-up.

Another further object of the present invention is to make better use of idle times in regular operations of the circuit for automatic calibrating cycles of the current sources.

In accordance with the objects of this invention a new circuit is described, capable of realizing a dynamically matched array of current sources, comprising as components: an Internal Current Reference stage; an array of Current Source sets having selectable trim bit elements; a Current Comparator device together with one or more controlled single-pole Toggle Switches; and a Trim Bit Select Logic (TBSL) block, whereby each set of Current Sources is on one side connected to said Internal Current Reference stage and on the other side outputting its source current to one of said controlled single-pole Toggle Switches, furthermore each of said controlled single-pole Toggle Switches relays either to its output terminal or to one input terminal of said Current Comparator device, which in turn receives also input on another input terminal from said Internal Current Reference stage thus allowing comparison under control from said TBSL block, so that each Current Source set can be matched to said Internal Current Reference with the help of said selectable trim bit elements.

Also in accordance with the objects of this invention a new method is described, capable of implementing a dynamically matched array of current sources and realized as an Integrated Circuit (IC) fabricated in MOS technology, comprising: providing an Internal Current Reference (ICR) as master reference for a dynamically Current Source (CS) matching system; equipping the ICR circuit with a current source or current mirror circuit exhibiting a Reference Current Transistor (RCT) endowed with a normative gate width of W=100; providing an array of CS sets which are to be matched dynamically with respect to the ICR; arranging each of the CS sets as a parallel connection of one main transistor with relative gate width W=100−X and a series of trim bit transistors with relative gate widths W=w1, w2, . . . X; adding for each trim bit transistor a controllable bit selector switch in serial connection with said trim bit transistor; providing a controllable Toggle Switch (TS) device for each of the CS sets;

defining the positions/pins of said TS device: one as TS_Calibrating and the other as TS_Operating-Output; providing a Current Comparator (CC) circuit; providing a Trim Bit Select Logic (TBSL) block; adjusting by the help of the TS devices in TS_Calibrating position, the CC and the TBSL the sizes of the array of CS sets by setting said respective bit selector switches appropriately so that the CS sets accurately match said master reference; and saving the results of said adjusting for the normal operation of the array of the CS sets with all bit selector switches accordingly set and said TS devices in TS_Operating-Output position.

Finally in accordance with the objects of this invention a method is described, capable of implementing a dynamically matched array of current sources and realized as an Integrated Circuit (IC) fabricated in semiconductor technology, comprising: providing an Internal Current Reference (ICR) circuit in MOSFET technology for a dynamically Current Source (CS) matching system; providing an array of MOSFET CS sets which are to be matched dynamically with respect to the ICR; providing a controllable Toggle Switch (TS) device for each of the CS sets with one common pole and two toggle positions/pins; providing a Current Comparator (CC) circuit with differential inputs and a logic output; providing a Trim Bit Select Logic (TBSL) block; equipping the ICR circuit with a current source or current mirror circuit exhibiting a Reference Current Transistor (RCT) endowed with a normative gate width of W=100; connecting the source of the RCT to a power supply terminal; connecting the gate of the RCT to an external reference current terminal; delivering as drain current from the RCT an Internal Reference current IREF; arranging each of the CS sets as a parallel connection of one main transistor with relative gate width W=100−X and a series of trim bit transistors with relative gate widths W=w1, w2, . . . X; adding for each trim bit transistor a controllable bit selector switch in serial connection from one side of the switch to the drain of said trim bit transistor; conjoining the sources of all transistors in the CS sets together and to the source of the RCT (and the power supply terminal); conjoining the gates of all transistors in the CS sets together and to the gate of the RCT (and the external reference current terminal); conjoining all the other sides of the controllable bit selector switches in each CS set together and to the drain of the main transistor of each CS set respectively; furnishing as output current of each CS set the currents from the conjoined main and switched ON trim bit transistors to the common pole of said TS device for each CS set respectively; defining the positions/pins of said TS device: one as TS_Calibrating and the other as TS_Operating-Output; interconnecting the TS_Calibrating positions/pins from all TS devices together and to the non-inverting input of said CC circuit; feeding said Internal Reference current IREF into the inverting input of said CC circuit thus preparing the CC circuit for a current comparison of the output currents from all CS sets with IREF in a 'one at a time' fashion; endowing said TBSL block with an input receiving the logical output signal from said CC circuit and multiple outputs to control said controllable bit selector switches and said TS devices; installing an adaptable calibration and trimming algorithm into the TBSL block considering other ancillary conditions of the system in order to dynamically match the array of CS sets to said ICR within the prescribed accuracy limits; configuring the TBSL block in such a way, that all bit selector switches and all TS devices are controlled by following said TBSL owned calibration and trimming algorithm; establishing an initial condition of the dynamically CS matching system so that all bit selector switches are in their OFF position and all TS devices are in their TS_Operating-Output position; starting said calibration and trimming algorithm for dynamically matching the CS sets from the CS array by resetting a CS array counter; as begin of a CS-ARRAY-loop: incrementing said CS array counter by one; selecting one CS set with actual CS array counter number for calibration and trimming by switching its according TS device into its TS_Calibrating position; as begin of a CS-SET-loop: activating an actual current comparison in said CC circuit and putting the logical High/Low result into said TBSL block as input; evaluating said input with regard to its conformance with the matching aim for that actual CS set as fitting to said ICR within the prescribed accuracy limits; in case of non-conformance to requirements closing or respectively opening appropriate bit selector switches in the actual CS set and looping back to the begin of said CS-SET-loop; in case of conformance to requirements exiting said CS-SET-loop; as end of the CS-SET-loop: saving the found positions of the bit selector switches as settings for that specific CS set in storage memory; configuring the actually selected CS set for normal operation by switching its according TS device into its TS_Operating-Output position; as end of CS-ARRAY loop: looping back to the begin of CS-ARRAY loop if there are any CS sets left for calibration and trim; and starting the normal operation of the dynamically CS matching system.

BRIEF DESCRIPTION OF THE DRAWINGS

In the accompanying drawings forming a material part of this description, the details describing a typical embodiment of the invention are shown.

DESCRIPTION OF THE PREFERRED EMBODIMENTS

Figure 1:
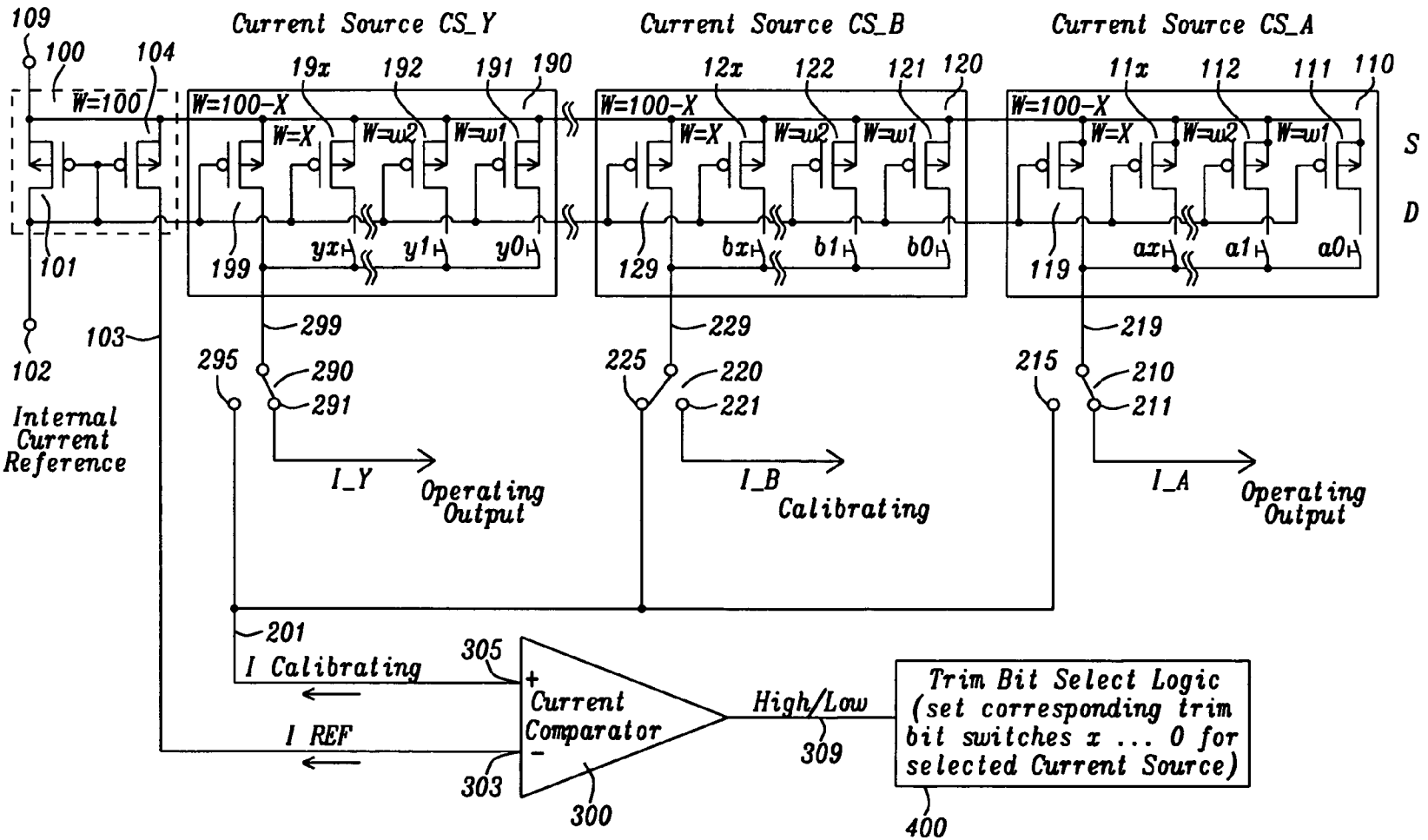
FIG. 1 shows the schematics of a typical circuit with sets of multiple current sources to be dynamically matched to a master reference current source as an exemplary embodiment of the new device according to this invention proposing a new matching technique.
Figure 2A:
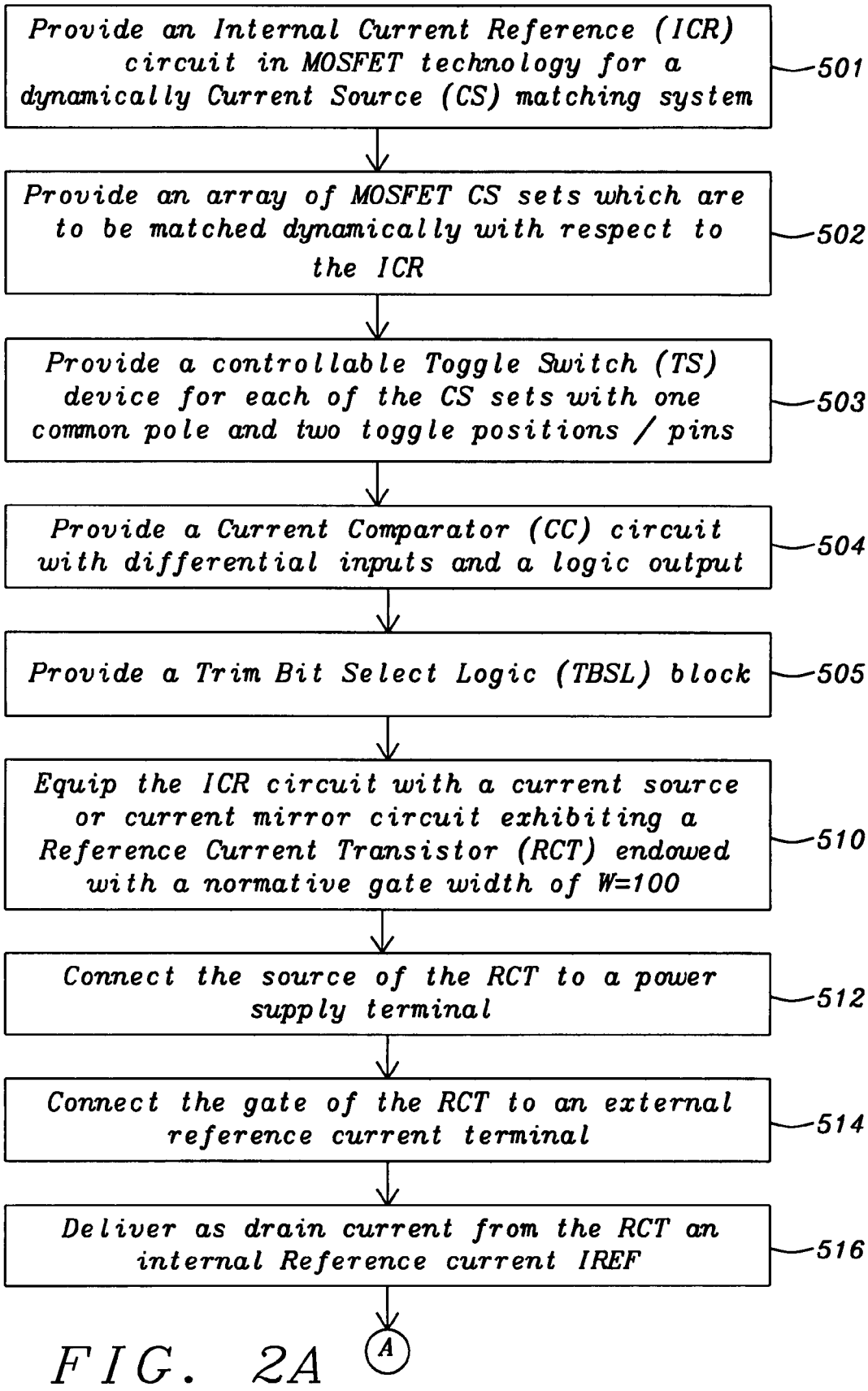
FIGS. 2A-2E describe with the help of a flow diagram the relevant method for building and operating new circuits for the dynamically matching device according to this invention as shown in FIG. 1 and described in the specification.
Figure 2B:
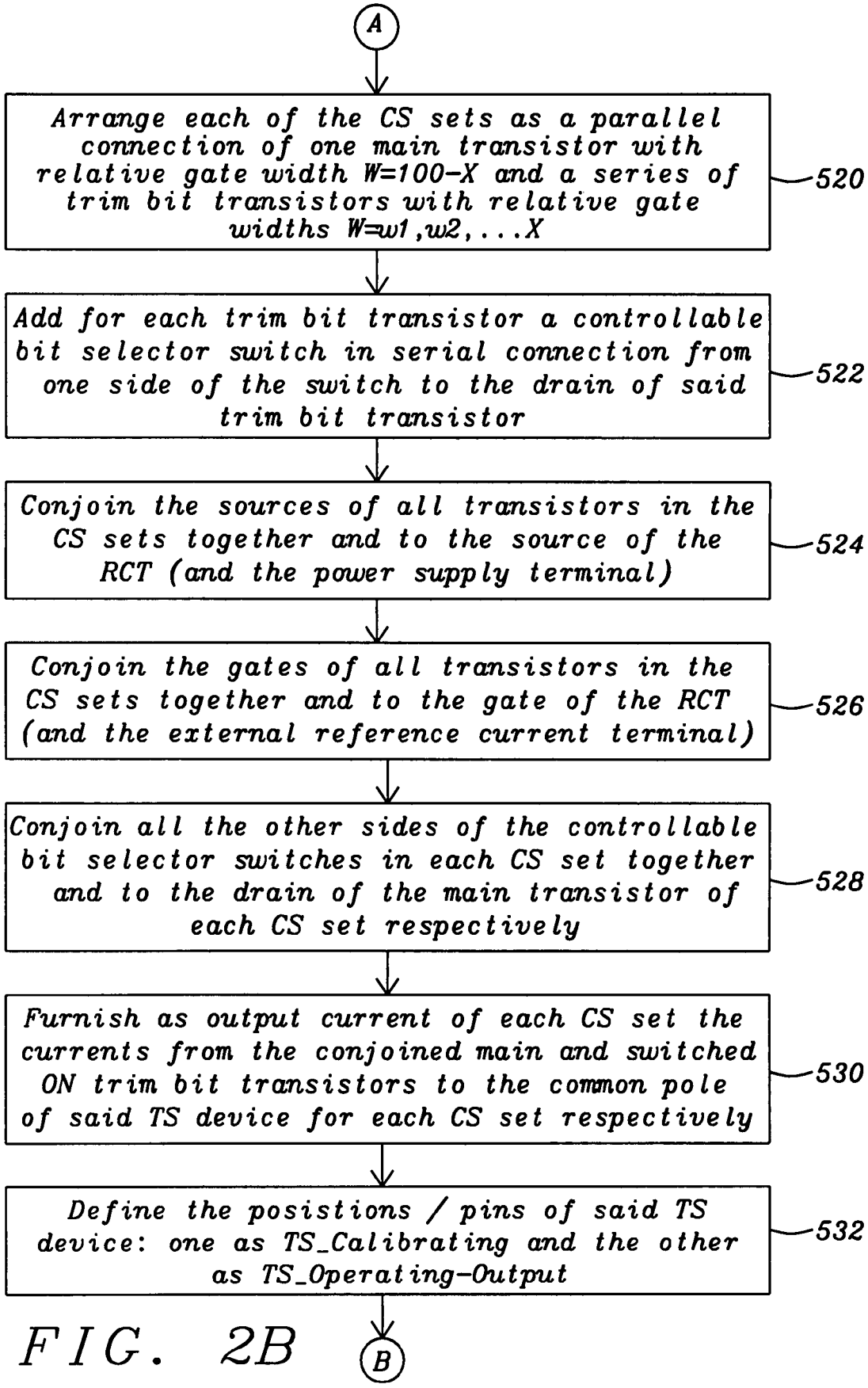
Figure 2C:
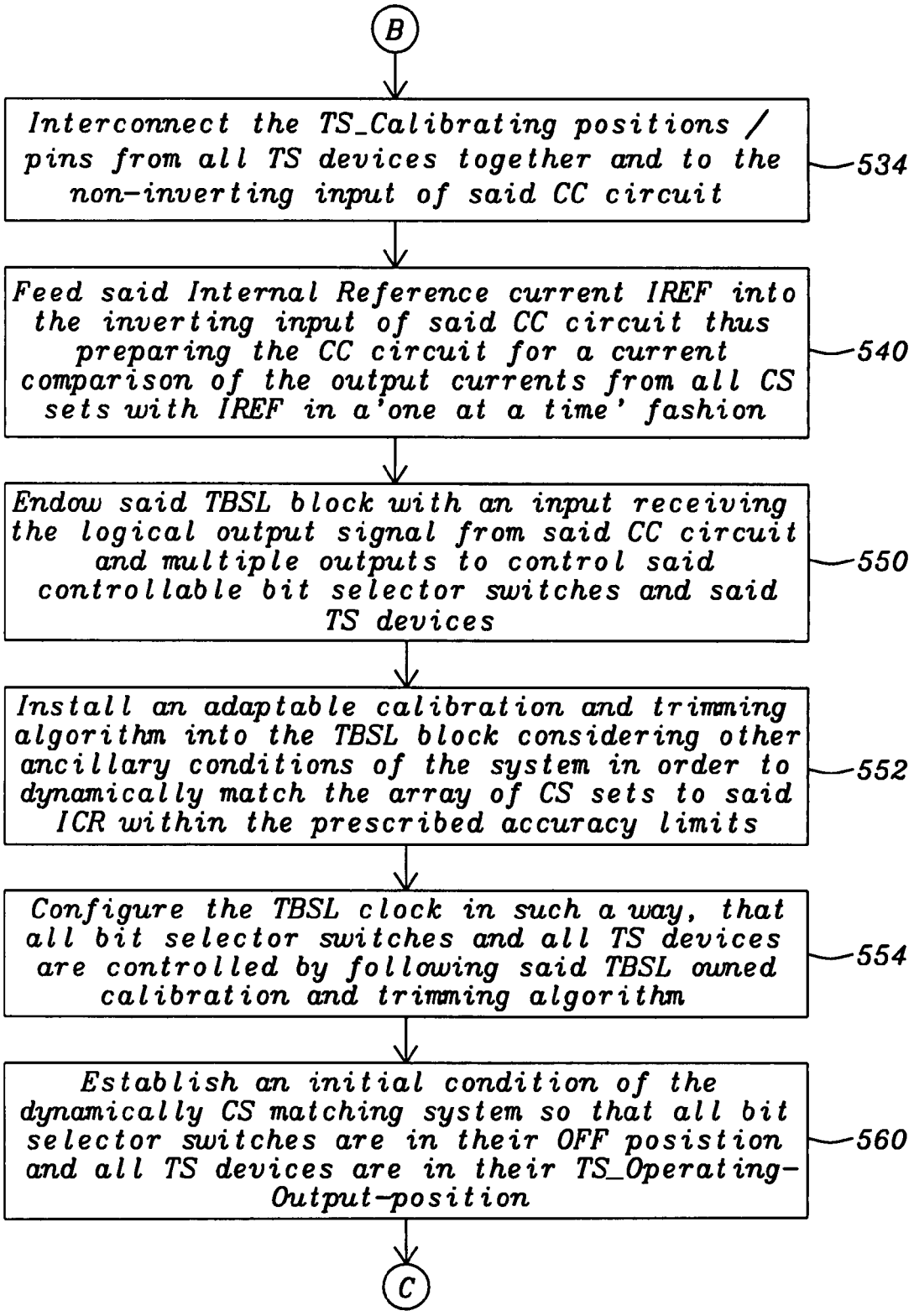
Figure 2D:
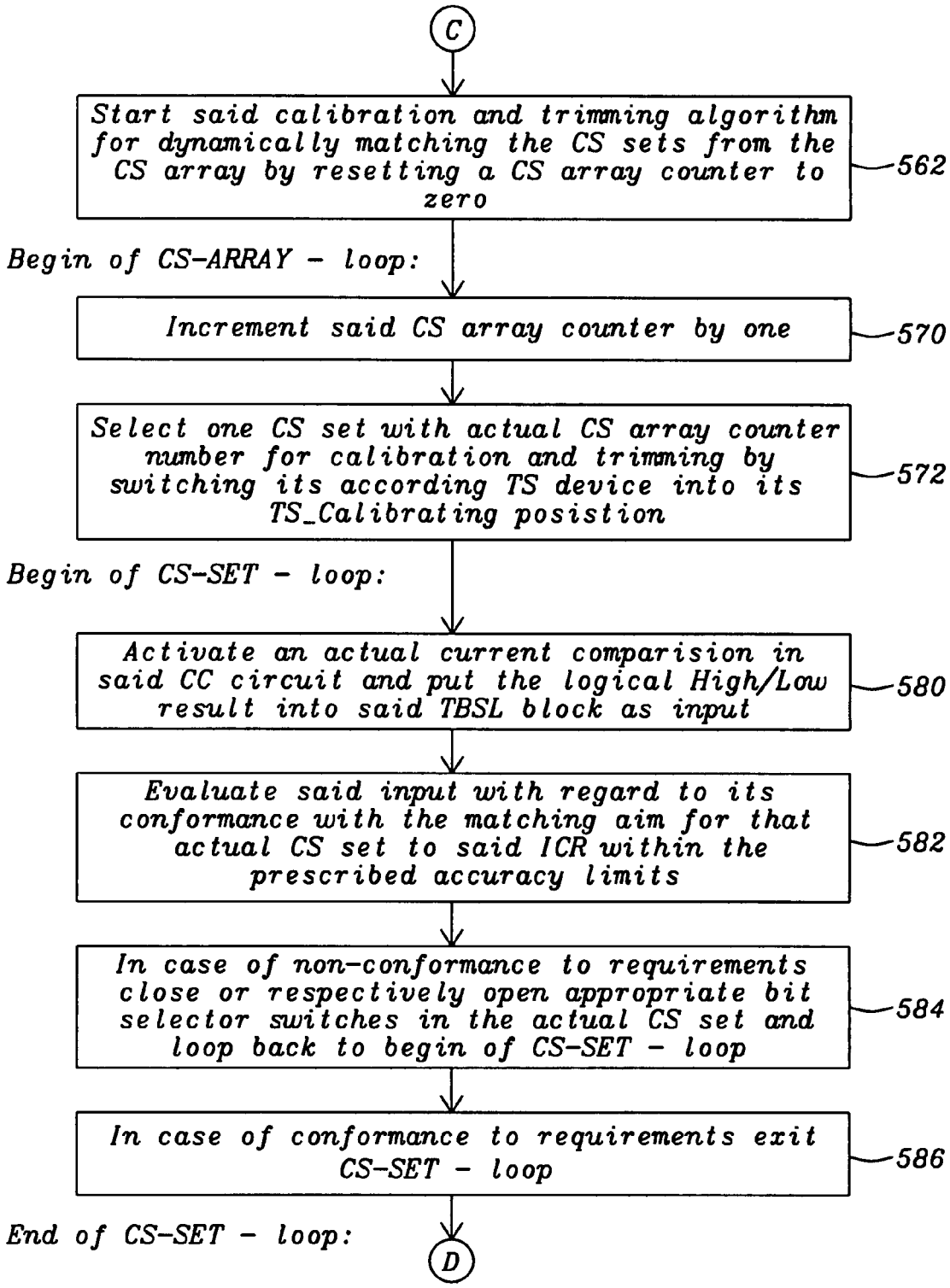
Figure 2E:
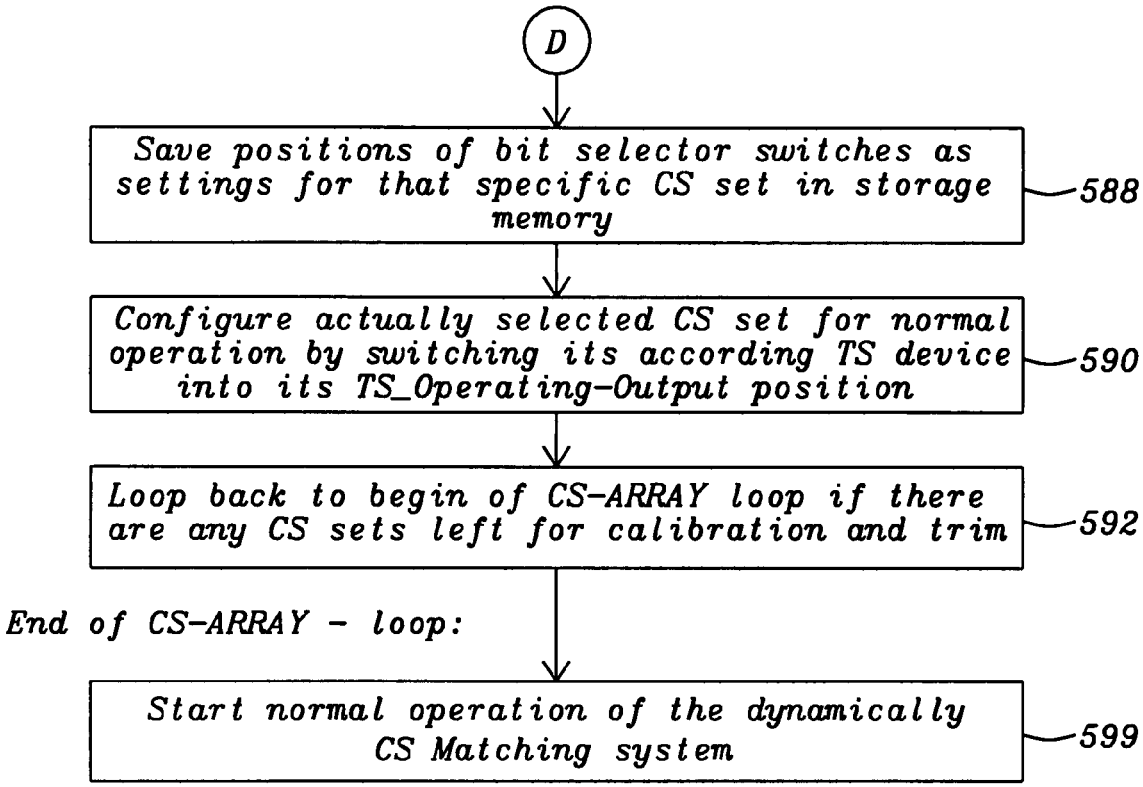

The preferred embodiment discloses a novel realization for circuits solving the problem of "Dynamic Matching of Current Sources" described here by one circuit as showcase and by its related method of operation. As already explained above there is a large variety of circuits usable as current sources or current mirrors. They all have in common that starting out from a first circuit part a very stable external reference current delivered from a high precision external current source reference circuit with low power characteristics the actual output current of the current source is generated by another, second circuit part with appropriate higher power characteristics concerning this output current but directly controlled by said external reference current. In its simplest case this second circuit part consists of one transistor only. The applied principle of controlling one current with another one, also makes the designation current mirror more meaningful in this context, whereby the relation of the currents can deviate from a proper 1:1 case as would be needed for a pure mirroring and where this relation is defined by the structural dimensions of the transistors. This way a current scaling is possible, namely either by scaling the emitter areas in the bipolar BJT case or by scaling the gate areas in the MOST case. These transistor areas are defined as rectangular areas with dimensions Width W and Length L, whereby in our case here only W shall be modulated and L will be held constant, for simplicity reasons. By scaling these output transistor areas for emitters or gates n times with respect to the reference current carrying transistor, the output current is also n times larger than said reference current. This may also be interpreted as being equivalent to placing n unit-size output transistors in parallel. Furthermore multiple copies of said output current can be generated—for different locations—by simply extending the idea of current mirrors to more than one current mirror within those second circuit parts i.e. output transistors, all arranged in parallel, thus allowing a realization of whole sets or arrays of current sources. From these explanations here and the remarks about structural transistor dimensions already made earlier it is now easily understood how important precision matching features within given accuracy limits are for sets or arrays of integrated current source devices. For a better understanding it shall only be mentioned here, that the first circuit part, which is also designated as master reference, namely said high precision external current source reference circuit is usually set up by some bandgap voltage reference circuit followed by a voltage to current converter circuit.

The technical approach to achieve the goal of avoiding most of the disadvantages with known quasi-static matching by dimensional layout or trimming procedures described earlier is now to append additional gate width weighted bitwise operating transistors (together with their related switches) for each current source and an accompanying 'Trim Bit Select Logic' for a dynamical matching system. Using the intrinsic advantages of that solution—as described later on in every detail—the construction of the circuits and the method for using these circuits according to the invention as realized with standard MOS technology is described and explained.

Contemplating now FIG. 1, a detailed circuit diagram of a new design for a dynamical matching current source array circuit and system with additional gate width weighted bitwise operating transistors (together with their related switches) for each current source and an accompanying Trim Bit Select Logic according to this invention for realization as MOS integrated circuit is depicted. As can be seen from the schematics there are mainly five circuit or system components. At first, an Internal Current Reference (100), the circuit of which is made up of two MOS transistors (here from the PMOS type) whereby the first one (101) is diode connected i.e. its gate and its drain are wire connected, and the second transistor (104) is controlling the Internal Reference current IREF as its output drain current flowing in line (103), whereby this control is effected by the commonly connected gates of both transistors (101, 104) which have to be closely matched in their technologically parameters by the way, thus leading to a highly stable Internal Reference current IREF (103). The sources of both transistors (101, 104) are commonly connected to the supply voltage terminal (109) of the circuit, in the PMOS case here bound to voltage level VDD. The drain and gate of said diode connected first transistor (101) are wired together and to terminal (102), which on its turn is receiving an external precision reference current as already described above, whereby here in the PMOS case that current is essentially derived from voltage level VDD. The relevant physical dimension for said second transistor (104) serving as Reference Current Transistor (RCT) which controls the Internal Reference current IREF (103) is the width W of the gate, which is here set to W=100, which means this width is used as the normative width for the whole system, whereto all other transistor gate widths are relating to (W=100 signifying a virtual 100% width); all transistor gate length dimensions L shall be set equal to L=1 as already explained above. It is well known that the drain current ratio I2/I1 in such current source or current mirror circuits is defined by the quotient WL2/WL1 of its ratios (WL=W/L) of the two transistors T1 and T2 involved. It shall be emphasized that the gate of the RCT is connected to terminal (102), the external reference current terminal, and the source of the RCT is connected to the supply voltage terminal (109) and thus gate and source are easily available for further connections.

As second component of the dynamically matching system according to the invention the array of Y actual Current Source sets CS_A, CS_B . . . CS_Y (110, 120 . . . 190) can be spotted, where each set itself is built from a series of X separate bit transistors (111, 112 . . . 11X; 121, 122 . . . 12X; to 191, 192 . . . 19X) with weighted gate widths counting as W=1, W=2, . . . W=X and each separately connectable in parallel to the main transistors of each set (119, 129 to 199) with their gate width W=100−X by their related bit selector switches (a0, a1 . . . aX; b0, b1 . . . bX; to y0, y1 . . . yX). This connecting transistors in parallel then produces a virtual transistor with a respectively summed up output current. The sources of all these transistors (111, 112 . . . 11X and 119; 121, 122 . . . 12X and 129; to 191, 192 . . . 19X and 199) are all wired together and connected to the supply voltage terminal (109), and therefore also connecting to the source of the RCT. The gates of all these transistors (111, 112 . . . 11X and 119; 121, 122 . . . 12X and 129; to 191, 192 . . . 19X and 199) are all wired together and connected to the external reference current terminal (102), and therefore connecting also to the gate of the RCT. The bit selector switches (a0, a1 . . . aX; b0, b1 . . . bX; to y0, y1 . . . yX) are operating as controlled single-pole ON/OFF switches, which themselves (a0, a1 . . . aX; b0, b1 . . . bX; to y0, y1 . . . yX) are each connected in series to the drains of their correspondent bit transistors (111, 112 . . . 11X; 121, 122 . . . 12X; to 191, 192 . . . 19X) on one side, on their other side they are for each Current Source set CS_A, CS_B . . . CS_Y (110, 120 . . . 190) setwise connected together and to the drain of their respective main transistors (119, 129 to 199) in each set. The drain current of each main transistor in each Current Source set CS_A, CS_B . . . CS_Y (110, 120 . . . 190) modified by the additional drain currents of the bit transistors (111, 112 . . . 11X; 121, 122 . . . 12X; to 191, 192 . . . 19X) with related switched ON bit switches out of the series of bit selector switches (a0, a1 . . . aX; b0, b1 . . . bX; to y0, y1 . . . yX) in each set is then used as resulting output current I_A, I_B . . . I_Y for each of said Current Source sets CS_A, CS_B . . . CS_Y (110, 120 . . . 190). These resulting output currents I_A, I_B . . . I_Y are each flowing through their respective output wires (219, 229 . . . 299) terminating in related terminal pins or switch contact poles.

In order to achieve an accurately matching for the output currents I_A, I_B . . . I_Y to said Internal Reference current IREF (103) according to a given precision as claimed in this invention the third, fourth and fifth components within the system of this invention are shown as required. Third component: a number of Y controlled single-pole Toggle Switches TS (210, 220 . . . 290). One switch for every output current I_A, I_B . . . I_Y from each Current Source set CS_A, CS_B . . . CS_Y (110, 120 . . . 190) feeding into the common pins (219, 229 . . . 299) of said switches, allowing to toggle these output currents I_A, I_B . . . I_Y either to their related output terminal pins (211, 221 . . . 291) or to their related calibration position pins (215, 225 . . . 295) respectively, depending on the state of the Trim Bit Select Logic. The respective TS positions and contact pins are named as TS_Operating_Output or as TS_Calibrating. The TS_Calibrating position pins (215, 225 . . . 295) of all controlled Toggle Switches TS (210, 220 . . . 290) are wired to each other in one common calibration point (201), which is possible because only one switch at a time is activated to this TS_Calibrating position during calibration. The fourth component of the system is a Current Comparator (300) with two differential inputs (303 and 305). The non-inverting input (305) of which is fed by a current named ICalibrating whereto said common calibration point (201) joining all TS_Calibrating position pins (215, 225 . . . 295) is connected to this input, whereas the inverting input (303) of the Current Comparator (300) is fed by said Internal Reference current IREF (103) from said Internal Current Reference (100). The outcome of a comparison of the currents ICalibrating and IREF is then fed as logical signal via the Current Comparator output (309) into the fifth system component, namely said Trim Bit Select Logic (TBSL) block (400). This TBSL block (400) contains all the necessary functions for generating the control signals to said bit selector switches (a0, a1 . . . aX; b0, b1 . . . bX; to y0, y1 . . . yX) and to said controlled single-pole Toggle Switches TS (210, 220 . . . 290), the control signals lines of which are not shown however in the drawing FIG. 1. It is understood that all these controlled switches are implemented as MOSFET switches. The TBSL block also contains the logical programs enabling various dynamic calibrating or trimming algorithms depending on operational boundary conditions in order to be able to integrate and adapt smoothly to different tasks, inter alia there are decisions to be made based on said Current Comparator output (309) signal, whether the trimming procedure can be successfully terminated after piecewise calibrating the Current Source CS_A, CS_B . . . CS_Y (110, 120 . . . 190) in each set by setting the bit selector switches appropriately. Furthermore there are storage functions needed for memory operations, e.g. to save the settings of said bit selector switches (a0, a1 . . . aX; b0, b1 . . . bX; to y0, y1 . . . yX) or to save other specifications e.g. from pertaining LEDs to be taken into consideration during the run of the calibration algorithms or during regular operations.

Thus in effect an array of Y separate Current Sources CS_A, CS_B . . . CS_Y (110, 120 . . . 190) is built with one output terminal (211, 221 . . . 291) each, wherefrom the resulting, now accurately IREF matching output currents I_A, I_B . . . I_Y from each Current Source CS_A, CS_B . . . CS_Y (110, 120 . . . 190) can be drawn, whereby each of the output currents I_A, I_B . . . I_Y is scaled with IREF by the W/L ratios of the involved and bit selector switch activated MOSFETs. Another point worth to be considered separately is the type of distribution of the gate widths for the switchable trim bit transistors (111, 112 . . . 11X; 121, 122 . . . 12X; to 191, 192 . . . 19X). If the gate widths variation, counting as W=w1, W=w2, . . . W=X, is taken in linear steps and each separate switchable selector trim bit transistor combination is connected in parallel to the main transistor of each set (119, 129 to 199) with said gate width W=100−X in the case of X=3 for example, the series of resulting gate widths is reaching from W=100−X=100−3=97 (all switches OFF) to W=97+1+2+3=103 (all switches ON) in integer steps. For X=5 this series is extending from W=95 to W=110, for X=8 it is reaching from W=92 to W=128. A choice for the number of switchable selector trim bit transistor combinations corresponding to the number of bits determining the trim range has to be made, also depending on the prescribed accuracy of the current source trimming which is purely a function of the size of the Least Significant Bit (LSB) of the master reference current (given that current as binary digit with a prescribed resolution), such that the calibrated current source is within one LSB of the master reference current (for example corresponding to 1%). Another choice is possible for the distribution of the trim bits, in contrast to the above linearity weighted gate widths or current addends also other distributions, such as binary weighted laws (following power of two rules) are thinkable, resulting in other trim ranges and trim accuracy results for the LSB.

With the help of FIGS. 2A-2E the detailed building, operation and functioning of the dynamically Current Source matching circuit and system of the current invention as presented in FIG. 1 shall now be thoroughly explained for a complete characteristic basic evaluation loop of its calibrating and trimming cycle.

Regarding the flow diagram given by FIGS. 2A-2E the method, explaining the construction and operation of the novel realization of an integrated circuit for matched Current Source devices according to the invention and exemplified by FIG. 1 is now described and defined by its steps, wherein the first steps 501-505 provide an Internal Current Reference (ICR) circuit in MOSFET technology for a dynamically Current Source (CS) matching system, provide an array of MOSFET CS sets which are to be matched dynamically with respect to the ICR, provide a controllable Toggle Switch (TS) device for each of the CS sets with one common pole and two toggle positions/pins, also provide a Current Comparator (CC) circuit with differential inputs and a logic output, and finally provide a Trim Bit Select Logic (TBSL) block. Step 510 equips the ICR circuit with a current source or current mirror circuit exhibiting a Reference Current Transistor (RCT) endowed with a normative gate width of W=100. In steps 512 and 514 connections of the source of the RCT to a power supply terminal and connections of the gate of the RCT to an external reference current terminal are made. Step 516 delivers as drain current from the RCT an Internal Reference current IREF, step 520 arranges each of the CS sets as a parallel connection of one main transistor with relative gate width W=100−X and a series of trim bit transistors with relative gate widths W=1, 2, . . . X. In step 522 for each trim bit transistor a controllable bit selector switch in serial connection from one side of the switch to the drain of said trim bit transistor is added. Steps 524-528 conjoin the sources of all transistors in the CS sets together and to the source of the RCT (and the power supply terminal), also conjoining the gates of all transistors in the CS sets together and to the gate of the RCT (and the external reference current terminal) and finally conjoining all the other sides of the controllable bit selector switches in each CS set together and to the drain of the main transistor of each CS set respectively. Step 530 furnishes as output current of each CS set the currents from the conjoined main and switched ON trim bit transistors to the common pole of said TS device for each CS set respectively. Step 532 defines the positions/pins of said TS device: one as TS_Calibrating and the other as TS_Operating-Output. With step 534 the TS_Calibrating positions/pins from all TS devices are together and to the non-inverting input of said CC circuit interconnected. Step 540 feeds said Internal Reference current IREF into the inverting input of said CC circuit thus preparing the CC circuit for a current comparison of the output currents from all CS sets with IREF in a 'one at a time' fashion. Step 550 endows said TBSL block with an input receiving the logical output signal from said CC circuit and multiple outputs to control said controllable bit selector switches and said TS devices. Steps 552 and 554 install an adaptable calibration and trimming algorithm into the TBSL block considering other ancillary conditions of the system in order to dynamically match the array of CS sets to said ICR within the prescribed accuracy limits and configure the TBSL block in such a way, that all bit selector switches and all TS devices are controlled by following said TBSL owned calibration and trimming algorithm. Step 560 establishes an initial condition of the dynamically CS matching system so that all bit selector switches are in their OFF position and all TS devices are in their TS_Operating-Output position. At step 562 starts said calibration and trimming algorithm for dynamically matching the CS sets from the CS array by resetting a CS array counter to zero. Step 570, which increments said CS array counter by one marks the begin of the CS-ARRAY-loop, which continues with step 572, selecting one CS set with the actual CS array counter number for calibration and trimming by switching its according TS device into its TS_Calibrating position. Step 580 marks the begin of the CS-SET-loop by activating an actual current comparison in said CC circuit and put the logical High/Low result into said TBSL block as input. The following steps 582-586 within this loop evaluate said input with regard to its conformance with the matching aim for that actual CS set to said ICR within the prescribed accuracy limits and in case of non-conformance to requirements close or respectively open appropriate bit selector switches in the actual CS set and loop back to begin of CS-SET-loop or in case of conformance to requirements exit said CS-SET-loop, which signifies also the end of the CS-SET-loop. Step 588 saves the found positions of the bit selector switches as settings for that specific CS set in storage memory and step 590 configures the actually selected CS set for normal operation by switching its according TS device into its TS_Operating-Output position. By step 592 a loop back to the begin of the CS-ARRAY loop is done, if there are any CS sets left for calibration and trim which also signifies the end of the CS-ARRAY loop. Finally step 599 starts the normal operation mode of the dynamically CS matching system.

It is understood that the proposed embodiment with MOSFETs of the PMOS type as particularly shown here, and described and explained above is chosen only as a demonstration for the teachings and ideas of this invention. The teachings and ideas of the proposed schemes can therefore also be applied to circuits with MOSFETs of the NMOS type, and also to circuits with other transistor technologies. Several hints and remarks to this conclusion have already been given above.

The ideas and principles shown in this patent application have been verified for instance by circuit design and simulation of an implementation realizing a wide swing cascoded arrangement for a current mirror circuit (however applicable to all types of current source/mirror/sink/load circuits), furthermore applying a binary weighted trim bit distribution rule and employing a successive approximation method for its calibrating and trimming algorithm.

Especially mentioned and emphasized shall be the fact of the possible arbitrary choices for both, the trim bit distribution rules and the calibrating and trimming algorithms as described above, thus allowing an easy and flexible adaptation to special needs within a specific implementation.

The current invention has now been electrically and technologically described and explained in great detail. The manufacturing process for semiconductor realizations in MOS technology is especially suited for these type of larger current source arrays.

Summarizing the essential features of the realization of the circuit we find, that in integrated circuit embodiments of the present invention a novel circuit and method is implemented, able to provide an easy and cost saving to implement precisely dynamically matching procedure for arrays of current sources which altogether meets in better reliability and quality products.

As shown in the preferred embodiment the novel system, circuits and methods provide an effective and manufacturable alternative to the prior art.

Consequently, although only one typical embodiment of the present invention has been described in detail, it should be understood that the present invention may be embodied in many other specific forms without departing from the spirit or scope of the be modified within the scope of the appended claims. While the invention has been particularly illustrated and described with reference to the preferred embodiment, it will be understood by those skilled in the art that various changes in form and details may be made without departing from the spirit and scope of the invention. Having shown and explained the principles of this invention with the aid of the given method it should also be readily apparent to those skilled in the art that the invention can be modified in arrangement and structure without departing from such principles. We therefore claim all modifications coming within the spirit and scope of the accompanying claims.

What is claimed is:

1. A circuit, realizing a dynamically matched array of current sources, comprising as components:

an Internal Current Reference stage;

an array of Current Source sets having selectable trim bit elements;

a Current Comparator device together with one or more controlled single-pole Toggle Switches; and a Trim Bit Select Logic (TBSL) block, whereby each set of Current Sources is on one side connected to said Internal Current Reference stage and on the other side outputting its source current to one of said controlled single-pole Toggle Switches, furthermore each of said controlled single-pole Toggle Switches relays either to its output terminal or to one input terminal of said Current Comparator device, which in turn receives also input on another input terminal from said Internal Current Reference stage thus allowing comparison under control from said TBSL block, so that each Current Source set can be matched to said Internal Current Reference with the help of said selectable trim bit elements.

2. The circuit according to claim 1 wherein said Internal Current Reference stage comprises a first and a second transistor.

3. The circuit according to claim 1 wherein said first transistor is diode connected.

4. The circuit according to claim 1 wherein said second transistor serves as Current Reference Transistor (CRT) whose drain current is used as Internal Reference current IREF.

5. The circuit according to claim 1 wherein said Current Source set comprises a main transistor and one or more selectable trim bit elements.

6. The circuit according to claim 5 wherein said trim bit elements comprise a trim bit transistor.

7. The circuit according to claim 5 wherein said trim bit elements comprise a controlled bit selector switch.

8. The circuit according to claim 7 wherein said controlled bit selector switch consists of a switching transistor.

9. The circuit according to claim 1 wherein said Current Source set comprises one or more controllable bit selector transistors.

10. The circuit according to claim 9 whereby said controllable bit selector transistors are implemented as differently dimensioned by their W/L-ratio and as such weighted transistors according to some arbitrary W/L-ratio distribution law.

11. The circuit according to claim 1 wherein said Current Source set comprises one or more controlled bit selector switches.

12. The circuit according to claim 11 whereby said controlled bit selector switches are dimensionally adapted to their corresponding controllable bit selector transistors inasmuch their W/L-ratios are somehow related.

13. The circuit according to claim 1 wherein said controlled single-pole Toggle Switches have a common pin and two alternatingly connected pins with its defined positions TS_Operating-Output or TS_Calibrating.

14. The circuit according to claim 1 wherein said Current Comparator device has a differential input with a non-inverting terminal and an inverting terminal.

15. The circuit according to claim 1 wherein said Current Comparator device has an output furnishing a logical signal.

16. The circuit according to claim 1 wherein said Trim Bit Select Logic (TBSL) block has an input and more than one outputs.

17. The circuit according to claim 1 whereby said Current Comparator device and said TBSL block are co-operating together with said controlled single-pole Toggle Switches in such a way, that in all times not more than one set of Current Sources is feeding its output current into said Current Comparator device via one of said controlled single-pole Toggle Switches, this one then being switched into its TS_Calibrating position during calibration operations.

18. The circuit according to claim 1 whereby said TBSL block is operating in such a way, that all said controlled single-pole Toggle Switches are being switched into their TS_Operating-Output position during regular current source operation of the circuit.

19. The circuit according to claim 1 wherein said components are MOSFET components.

20. The circuit according to claim 19 wherein said MOSFET components are of the NMOS type.

21. The circuit according to claim 19 wherein said MOSFET components are of the PMOS type.

22. The circuit according to claim 1 manufactured as Integrated Circuit (IC) in monolithic MOS technology.

23. A method for implementing a dynamically matched array of current sources comprising:

providing an Internal Current Reference (ICR) as master reference for a dynamically Current Source (CS) matching system;

equipping the ICR circuit with a current source or current mirror circuit exhibiting a Reference Current Transistor (RCT) endowed with a normative gate width of W=100;

providing an array of CS sets which are to be matched dynamically with respect to the ICR;

arranging each of the CS sets as a parallel connection of one main transistor with relative gate width W=100−X and a series of trim bit transistors with relative gate widths W=w1, w2, . . . X;

adding for each trim bit transistor a controllable bit selector switch in serial connection with said trim bit transistor;

providing a controllable Toggle Switch (TS) device for each of the CS sets;

defining the positions/pins of said TS device: one as TS_Calibrating and the other as TS_Operating-Output;

providing a Current Comparator (CC) circuit;

providing a Trim Bit Select Logic (TBSL) block;

adjusting by the help of the TS devices in TS_Calibrating position, the CC and the TBSL the sizes of the array of CS sets by setting said respective bit selector switches appropriately so that the CS sets accurately match said master reference; and saving the results of said adjusting for the normal operation of the array of the CS sets with all bit selector switches accordingly set and said TS devices in TS_Operating-Output position.

24. The method according to claim 23 wherein said step of arranging each of the CS sets as a parallel connection of one main transistor with relative gate width W=100−X and a series of trim bit transistors with relative gate widths W=w1, w2, . . . X and the latter is carried out as gate width series following a linear law.

25. The method according to claim 23 wherein said step of arranging each of the CS sets as a parallel connection of one main transistor with relative gate width W=100−X and a series of trim bit transistors with relative gate widths W=w1, w2, . . . X and the latter is carried out as gate width series following a binary weighted law.

26. A method for implementing a dynamically matched array of current sources and realized as an Integrated Circuit (IC) fabricated in MOSFET technology, comprising:

providing an Internal Current Reference (ICR) circuit in MOSFET technology for a dynamically Current Source (CS) matching system;

providing an array of MOSFET CS sets which are to be matched dynamically with respect to the ICR;

providing a controllable Toggle Switch (TS) device for each of the CS sets with one common pole and two toggle positions/pins;

providing a Current Comparator (CC) circuit with differential inputs and a logic output;

providing a Trim Bit Select Logic (TBSL) block;

equipping the ICR circuit with a current source or current mirror circuit exhibiting a Reference Current Transistor (RCT) endowed with a normative gate width of W=100;

connecting the source of the RCT to a power supply terminal;

connecting the gate of the RCT to an external reference current terminal;

delivering as drain current from the RCT an Internal Reference current IREF;

arranging each of the CS sets as a parallel connection of one main transistor with relative gate width W=100−X and a series of trim bit transistors with relative gate widths W=w1, w2, . . . X;

adding for each trim bit transistor a controllable bit selector switch in serial connection from one side of the switch to the drain of said trim bit transistor;

conjoining the sources of all transistors in the CS sets together and to the source of the RCT (and the power supply terminal);

conjoining the gates of all transistors in the CS sets together and to the gate of the RCT (and the external reference current terminal);

conjoining all the other sides of the controllable bit selector switches in each CS set together and to the drain of the main transistor of each CS set respectively;

furnishing as output current of each CS set the currents from the conjoined main and switched ON trim bit transistors to the common pole of said TS device for each CS set respectively;

defining the positions/pins of said TS device: one as TS_Calibrating and the other as TS_Operating-Output;

interconnecting the TS_Calibrating positions/pins from all TS devices together and to the non-inverting input of said CC circuit;

feeding said Internal Reference current IREF into the inverting input of said CC circuit thus preparing the CC circuit for a current comparison of the output currents from all CS sets with IREF in a 'one at a time' fashion;

endowing said TBSL block with an input receiving the logical output signal from said CC circuit and multiple outputs to control said controllable bit selector switches and said TS devices;

installing an adaptable calibration and trimming algorithm into the TBSL block considering other ancillary conditions of the system in order to dynamically match the array of CS sets to said ICR within the prescribed accuracy limits;

configuring the TBSL block in such a way, that all bit selector switches and all TS devices are controlled by following said TBSL owned calibration and trimming algorithm;

establishing an initial condition of the dynamically CS matching system so that all bit selector switches are in their OFF position and all TS devices are in their TS_Operating-Output position;

starting said calibration and trimming algorithm for dynamically matching the CS sets from the CS array by resetting a CS array counter;

as begin of a CS-ARRAY-loop: incrementing said CS array counter by one;

selecting one CS set with actual CS array counter number for calibration and trimming by switching its according TS device into its TS_Calibrating position;

as begin of a CS-SET-loop: activating an actual current comparison in said CC circuit and putting the logical High/Low result into said TBSL block as input;

evaluating said input with regard to its conformance with the matching aim for that actual CS set as fitting to said ICR within the prescribed accuracy limits;

in case of non-conformance to requirements closing or respectively opening appropriate bit selector switches in the actual CS set and looping back to the begin of said CS-SET-loop;

in case of conformance to requirements exiting said CS-SET-loop;

as end of the CS-SET-loop: saving the found positions of the bit selector switches as settings for that specific CS set in storage memory;

configuring the actually selected CS set for normal operation by switching its according TS device into its TS_Operating-Output position;

as end of CS-ARRAY loop: looping back to the begin of CS-ARRAY loop if there are any CS sets left for calibration and trim; and starting the normal operation of the dynamically CS matching system.

27. The method according to claim 26 wherein said step of arranging each of the CS sets as a parallel connection of one main transistor with relative gate width W=100−X and a series of trim bit transistors with relative gate widths W=w1, w2, . . . X and the latter is carried out as gate width series following a linear law.

28. The method according to claim 26 wherein said step of arranging each of the CS sets as a parallel connection of one main transistor with relative gate width W=100−X and a series of trim bit transistors with relative gate widths W=w1, w2, . . . X and the latter is carried out as gate width series following a binary weighted law.

29. The method according to claim 26 wherein said step of installing an adaptable calibration and trimming algorithm into the TBSL block is including the choice of a successive approximation method for said calibration and trimming algorithm.

30. The method according to claim 26 wherein said step of starting said calibration and trimming algorithm for dynamically matching the CS sets from the CS array by resetting a CS array counter includes resetting said counter to zero.

* * * * *